US008275612B2

(12) United States Patent
Kim et al.

(10) Patent No.: US 8,275,612 B2
(45) Date of Patent: Sep. 25, 2012

(54) METHOD AND APPARATUS FOR DETECTING NOISE

(75) Inventors: Nam-hoon Kim, Yongin-si (KR); Jeong-mi Cho, Suwon-si (KR); Byung-hwan Kwak, Yongin-si (KR); Ick-sang Han, Yongin-si (KR); Yiogchun Huang, Beijing (CN)

(73) Assignee: Samsung Electronics Co., Ltd, Suwon-Si (KR)

( * ) Notice: Subject to any disclaimer, the term of this patent is extended or adjusted under 35 U.S.C. 154(b) by 1164 days.

(21) Appl. No.: 12/081,409

(22) Filed: Apr. 15, 2008

(65) Prior Publication Data

US 2009/0157398 A1 Jun. 18, 2009

(30) Foreign Application Priority Data

Dec. 17, 2007 (KR) ..... 10-2007-0132648

(51) Int. Cl.
*G10L 21/02* (2006.01)

(52) U.S. Cl. ..... 704/226

(58) Field of Classification Search ..... 704/226–228, 704/233
See application file for complete search history.

(56) References Cited

U.S. PATENT DOCUMENTS

2004/0210436 A1 * 10/2004 Jiang et al. ..... 704/222
2008/0065380 A1 * 3/2008 Kwak et al. ..... 704/243

* cited by examiner

*Primary Examiner* — Angela A Armstrong
(74) *Attorney, Agent, or Firm* — Staas & Halsey LLP

(57) ABSTRACT

A method of and apparatus for detecting noise are provided. The method of detecting noise includes: receiving an input of a voice frame and converting the voice frame into a filter bank vector; converting the converted filter bank vector into band data; calculating a weight Gaussian mixture model (GMM) for each band by using the converted band data; and detecting noise in the voice frame based on the calculation result.

10 Claims, 7 Drawing Sheets

METHOD AND APPARATUS FOR DETECTING NOISE

CROSS-REFERENCE TO RELATED PATENT APPLICATIONS

This application claims the benefit of Korean Patent Application No. 10-2007-0132648, filed on Dec. 17, 2007, in the Korean Intellectual Property Office, the disclosure of which is incorporated herein in its entirety by reference.

BACKGROUND OF THE INVENTION

1. Field of the Invention

The present invention relates to a method of and apparatus for detecting noise, and more particularly, to a method of and apparatus for detecting noise for voice recognition in a mobile device.

2. Description of the Related Art

As the performance of mobile devices has improved and a variety of services in a mobile environment have been generally provided, a more convenient interface instead of a button input method is being requested. One of the technologies being highlighted as a replacement for the button input method is voice recognition.

However, due to the diversity of environments for mobile device use, the voice recognition in a mobile device is more exposed to a variety of noise environments than personal computer (PC)-based voice recognition. In particular, scratch noise due to a terminal gripping method, spike noise, and noise input from a surrounding environment in the process of recognition have a critical influence on the performance of the recognition. Also, since the characteristic of this noise is variable, it is difficult to remove this noise even though conventional noise removing algorithms are applied.

The most generally used method among the conventional noise detection technologies is using a power/energy change. This method has an advantage of simplicity in implementation and operability with a few resources, but has many errors in terms of the performance. Another approach is a statistical method using Gaussian mixture model (hereinafter referred to as GMM).

In the power/energy based detection method, a power/energy value is calculated in units of frames from a voice signal input, and according to whether or not the power/energy value exceeds a threshold, a noise signal is detected. This approach has the advantage of the simplicity in implementation and operability with a few resources, but it is difficult to set a threshold that can be applied to all environments, and the performance is limited because noise is determined simply by the power/energy value.

Meanwhile, in the method using the GMM, the probability value of each model is calculated by using a voice signal being input in units of frames, and by using the probability value, it is determined which model a current frame is similar to. The statistical approach using the GMM shows a satisfactory performance even in detection of scratch noise having a low power/energy value, and has better performance than that of the power/energy-based noise detection method. However, the statistical method using the GMM includes many errors when signals of similar characteristics are detected.

SUMMARY OF THE INVENTION

The present invention provides a noise detection method and apparatus by which a GMM for each band is formed from a filter bank vector obtained in a characteristic extraction process of voice recognition, and a weight is applied according to the power of discrimination of each band, thereby allowing a stable noise detection ability to be provided.

According to an aspect of the present invention, there is provided a method of detecting noise including: receiving an input of a voice frame and converting the voice frame into a filter bank vector; converting the converted filter bank vector into band data; calculating a weight Gaussian mixture model (GMM) for each band by using the converted band data; and detecting noise in the voice frame based on the calculation result.

According to another aspect of the present invention, there is provided an apparatus for detecting noise including: a filter bank analysis unit receiving an input of a voice frame and converting the voice frame into a filter bank vector; a band data converting unit converting the converted filter bank vector into band data; a band weight GMM calculation unit calculating a weight GMM for each band by using the converted band data; and a noise detection unit detecting noise in the voice frame based on the calculation result.

According to still another aspect of the present invention, there is provided a computer readable recording medium having embodied thereon a computer program for executing the methods.

Details and improvements of the present are disclosed in dependent claims.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

The present invention will now be described more fully with reference to the accompanying drawings, in which exemplary embodiments of the invention are shown.

Figure 1:
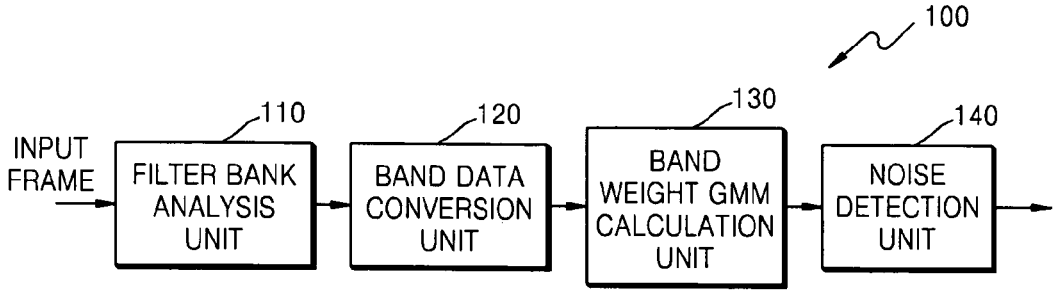
FIG. 1 is a schematic block diagram of a noise detection apparatus according to an embodiment of the present invention.

FIG. 1 is a schematic block diagram of a noise detection apparatus 100 according to an embodiment of the present invention.

Referring to FIG. 1, the noise detection apparatus 100 includes a filter bank analysis unit 110, a band data conversion unit 120, a band weight GMM calculation unit 130, and a noise detection unit 140.

The filter bank analysis unit 110 receives an input of a voice frame and converts the voice frame into a filter bank vector. In this case, the voice frame input to the filter bank analysis unit 110 is input after voice which is input to a voice recognition device is divided into predetermined frames. Also, for the input voice, a noise removing process may be performed, and then, after detecting only a speech part that is actually used for voice recognition, through end point detection, and dividing the speech part into frame units, the frame units may be input.

The band data conversion unit 120 receives filter bank vectors from the filter bank analysis unit 110 and converts the filter bank vectors into band data. That is, the filter bank vectors of entire frequency bands of voice frames are converted into data for respective bands. In this case, in relation to the data for each band, since the filter bank vectors for the entire frequency bands may cause errors in reflecting the characteristic for each band, the filter bank vectors for the entire frequency bands are converted into data for respective bands, thereby reducing the possibility of occurrence of such errors.

The band weight GMM calculation unit 130 calculates a weight GMM for each band by using the converted band data. The band weight GMM calculation unit 130 applies a weight for each band to a GMM for the band which is trained in advance, thereby performing the calculation. In this case, the GMM for each band is a GMM which is trained in advance by using voice data and label data, and the weight for each band is trained by using the trained GMM for each band, voice data, and label data. The training of the GMM for each band and the training of the weight for each band will be explained later with reference to FIGS. 6A through 6C. Through an ID result value of an input frame which is thus calculated, it can be confirmed whether or not noise that is an object of detection exists in a corresponding input frame.

The noise detection unit 140 confirms whether or not detection object noise exists in an input frame, according to the calculation result of the band weight GMM calculation unit 130.

Figure 2A:
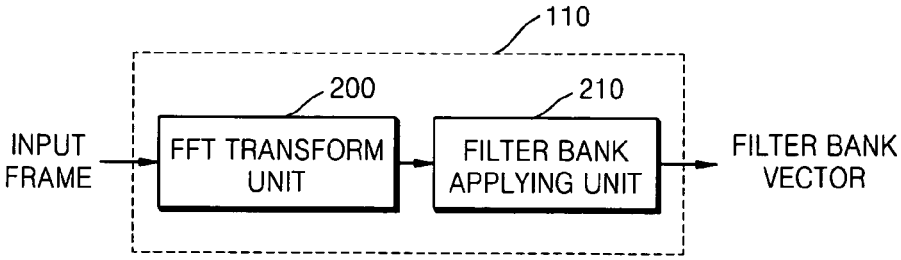
FIG. 2A is a block diagram illustrating a detailed structure of a filter bank analysis unit illustrated in FIG. 1 according to an embodiment of the present invention.

FIG. 2A is a block diagram illustrating a detailed structure of the filter bank analysis unit 110 illustrated in FIG. 1 according to an embodiment of the present invention.

The filter bank analysis unit 110 includes an FFT transform unit 200 and a filter bank applying unit 210. The FFT transform unit 200 performs fast Fourier transform of input frame data, thereby transforming the input frame data into the frequency domain. The filter bank applying unit 210 applies filter banks to the thus transformed frame data, thereby generating filter bank vectors. A filter bank vector is obtained by passing a voice signal through a frequency band pass filter in order to extract a characteristic vector of the voice signal. That is, the value of energy for each frequency band (filter bank energy) is used as the characteristic.

Figure 2B:
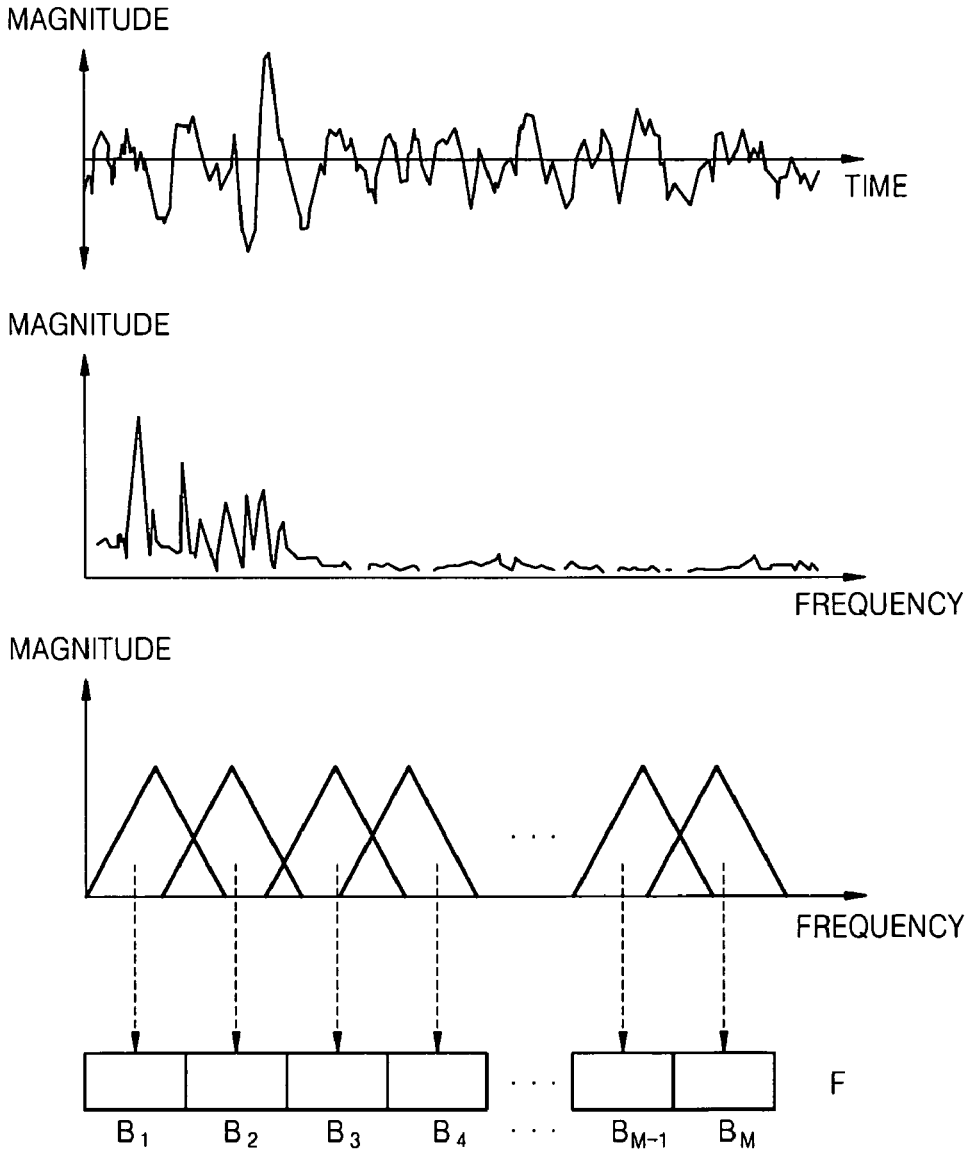
FIG. 2B is a diagram explaining the function of a filter bank analysis unit illustrated in FIG. 1 according to an embodiment of the present invention.

FIG. 2B is a diagram explaining the function of the filter bank analysis unit 110 illustrated in FIG. 1 according to an embodiment of the present invention.

Referring to FIG. 2B, frequency signals obtained through FFT transform pass through a plurality of filter banks illustrated in FIG. 2B, and then, a filter bank vector (F) formed with filter bank vectors ($B_1, B_2, B_3, \ldots, B_{M-1}, B_M$) covering the entire frequency bands is generated. Here, M is the order of the filter bank.

Figure 3A:
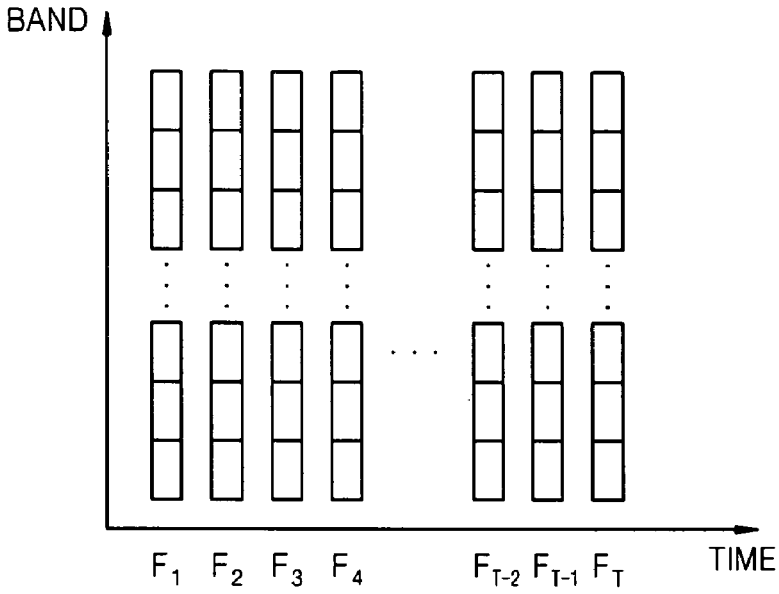
FIGS. 3A and 3B are diagrams explaining the function of a band data conversion unit illustrated in FIG. 1 according to an embodiment of the present invention.
Figure 3B:
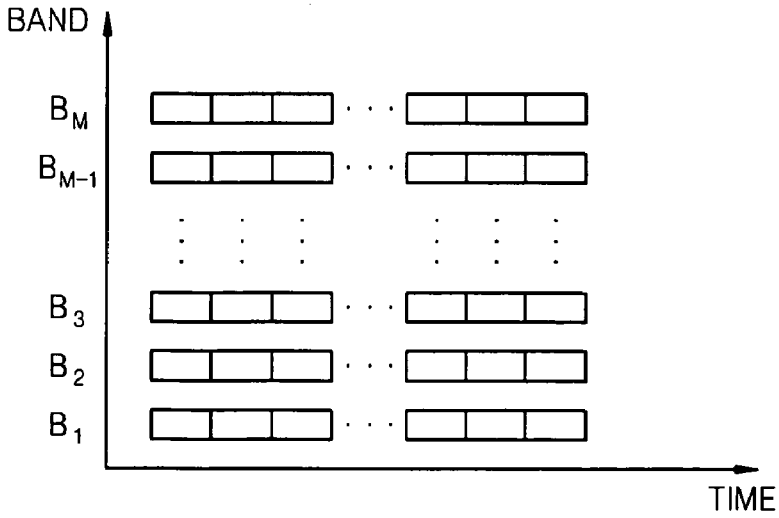

FIGS. 3A and 3B are diagrams explaining the function of a band data conversion unit illustrated in FIG. 1 according to an embodiment of the present invention.

FIG. 3A is a diagram illustrating the filter bank vector (F) illustrated in FIG. 2B, on the time axis. In this case, when a GMM is formed by using the filter bank vectors ($F_1, F_2, \ldots, F_{T-1}, F_T$), an error may occur. For example, although the frequency component of a silence interval concentrates in a low frequency band, some energy component existing in a high frequency band area may have an unwanted influence on a GMM model. Accordingly, the band data conversion unit 120 according to the current embodiment converts the filter bank vectors ($F_1, F_2, \ldots, F_{T-1}, F_T$) formed through the filter bank analysis unit 110 into data for respective bands illustrated in FIG. 3B. Accordingly, the characteristic of each frequency band, for example, the characteristic of a GMM for each band concentrating on a predetermined frequency band, can be reflected.

Figure 4:
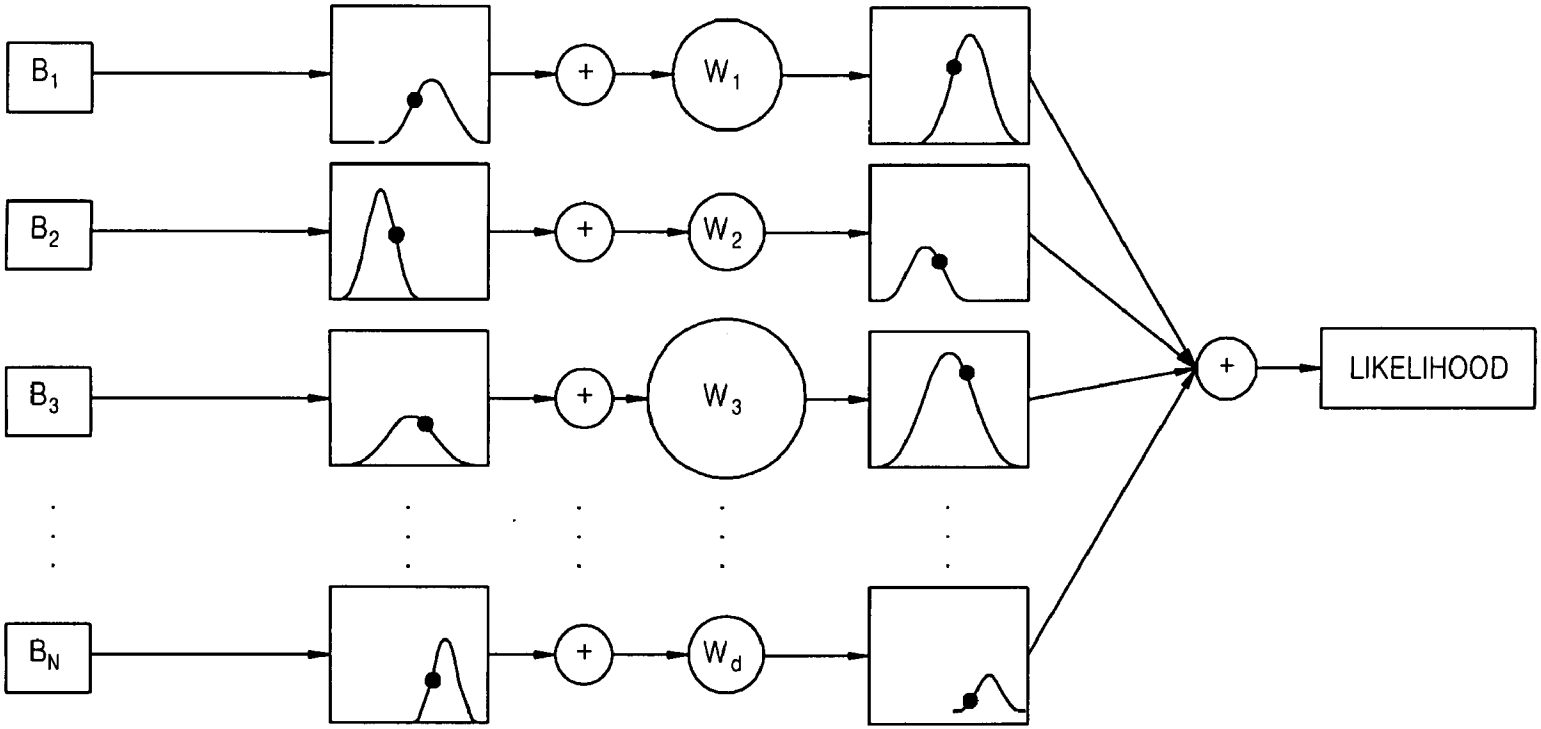
FIG. 4 is a diagram explaining the function of a band weight Gaussian mixture model (GMM) calculation unit illustrated in FIG. 1 according to an embodiment of the present invention.

FIG. 4 is a diagram explaining the function of the band weight GMM calculation unit 120 illustrated in FIG. 1 according to an embodiment of the present invention.

The band weight GMM calculation unit 130 applies band data and a weight for each band, which is trained in advance, to a GMM for the band, which is trained in advance, thereby calculating a probability value of a corresponding input frame.

In this case, the calculation of a GMM for each band to which a weight for the band is not applied is calculated according to equation 1 below:

$$L(O \mid \Phi) = \sum_{m=1}^{M} \sum_{n=1}^{N} [\log c_{mn} + \log N_m(O_m \mid \mu_{mn}, \sigma_{mn})] \tag{1}$$

Here, $L(O|\Phi)$ denotes a likelihood, M denotes a filter bank order, N denotes the number of mixtures, $C_{mn}$ denotes a mixture weight for each band, $O_m$ denotes an Input frame for each band, $\mu_{mn}$ denotes a Gaussian mean for each band, and $\sigma_{mn}$ denotes a Gaussian distribution for each band.

In the current embodiment, a probability value is calculated by applying a weight for each band to equation 1.

In this case, the weight for each band considers that there are differences among the powers of discrimination of GMM models for respective bands. The GMM model can be formed, including, for example, noise, silence, voiced sounds and unvoiced sounds, and the types of the GMM models are not limited to this. Here, GMMs for respective bands have different powers of discrimination. The power of discrimination of a GMM for each band will now be explained with reference to FIG. 5.

Figure 5:
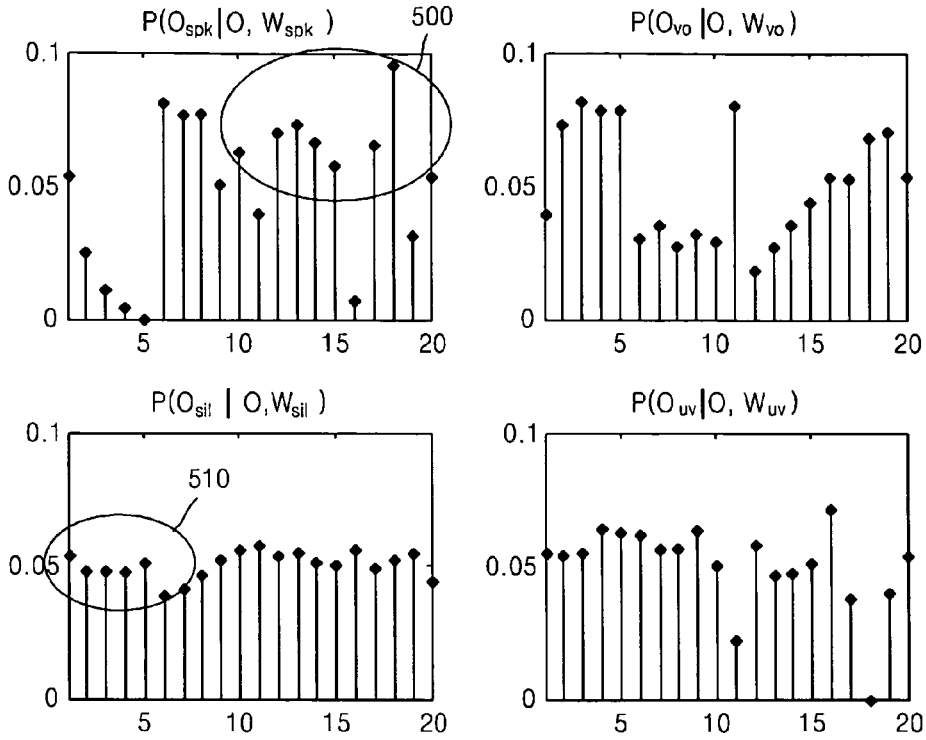
FIG. 5 is a diagram explaining a weight for each band according to an embodiment of the present invention.

Referring to FIG. 5, the power of discrimination of a GMM for each band of each class is illustrated. W_spk, W_sil, W_vo, and W_uv indicate the band GMM models of noise, silence, voiced sound, and unvoiced sound, respectively. Also, (O_spk|O, W_spk), P(O_sil|O, W_sil), P(O_spk|O, W_vo), and P(O_uv|O, W_uv) are normalized probability values for respective bands indicating probabilities that when each model is given, an arbitrary input value corresponds to the model.

As illustrated in FIG. 5, in determining the class of an input frame, it can be known that the powers of discrimination of GMMs for respective bands are different from each other. For example, in relation to the powers of discrimination of noise and silence for each band, in the case of the noise band GMM, a band GMM 500 of a high frequency band has a good power of discrimination, and in the case of the silence band GMM, a band GMM 510 of a low frequency band ha a good power of discrimination. Accordingly, in the current embodiment, this weight for each band is applied, thereby enabling efficient detection of noise in an input frame.

The band weight GMM calculation unit 130 applies a weight for each band to a GMM for the band, thereby calculating a weight GMM for the band. In this case, a probability value is calculated by applying band data and a weight for each band to a GMM for the band which is trained in advance. Also, by using the sum of band weight GMMs calculated for each band, an ID result value of an input frame is calculated, and it is determined whether or not noise exists. The calculation of the band weight GMM probability value is performed according to equation 2 below:

$$L(O \mid \Phi) = \sum_{m=1}^{M} \left[ \alpha \log w_m + \sum_{n=1}^{N} \{\log c_{mn} + \log N_m(O_m \mid \mu_{mn}, \sigma_{mn})\} \right] \quad (2)$$

Here, $L(O|\Phi)$ denotes a likelihood, M denotes a filter bank order, N denotes the number of mixtures, $C_{mn}$ denotes a mixture weight for each band, $O_m$ denotes an Input frame for each band, $\mu_{mn}$ denotes a Gaussian mean for each band, $\sigma_{mn}$ denotes a Gaussian distribution for each band, $w_{mn}$ denotes a band weight, and a denotes a band weight scaling factor.

In equation 2, by nonlinearly adjusting each band weight through the $\alpha$ value, a weight is given for each band and a GMM probability value can be calculated.

Figure 6A:
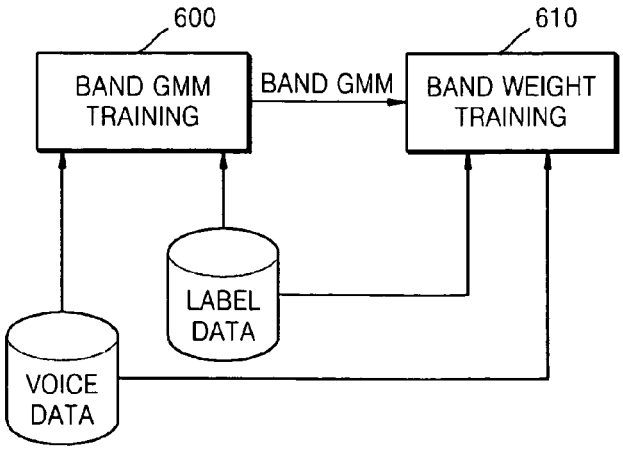
FIGS. 6A through 6C are diagrams explaining band GMM training and band weight training according to an embodiment of the present invention.
Figure 6B:
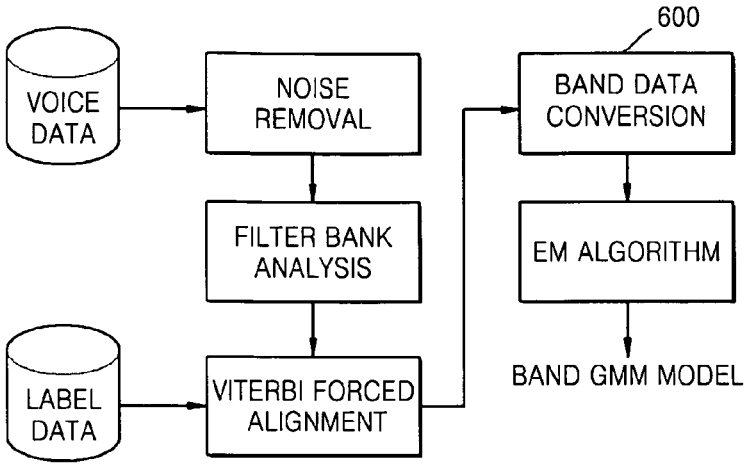
Figure 6C:
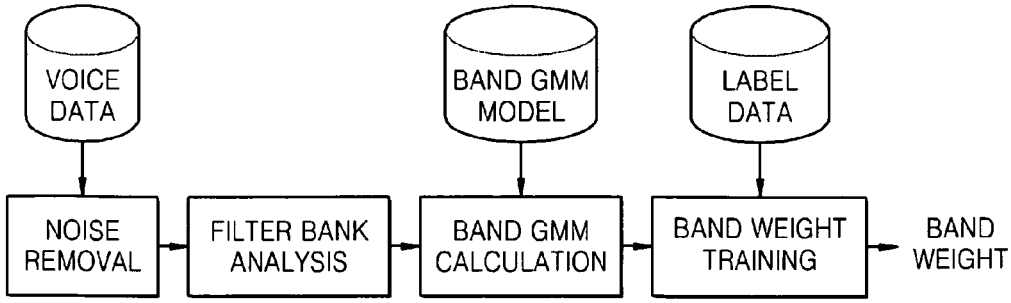

FIGS. 6A through 6C are diagrams explaining GMM training for each band and band weight training according to an embodiment of the present invention.

Referring to FIG. 6A, processes of band GMM training 600 and band weight training 610 are shown.

The band GMM training 600 will now be explained with reference to FIG. 6B. Noise is removed from voice data, and filter bank analysis of the voice data is performed in units of frames. By using label data, Viterbi forced alignment is performed for filter bank vectors. For filter bank vectors for each class obtained through this process, band data conversion is performed in each band, and training data for each band forms a final band-based GMM model through an expectation-maximization (EM) algorithm.

The band weight training 610 will now be explained with reference to FIG. 6C. Like the band GMM training, noise is removed from voice data and filter bank analysis of the voice data is performed. Then, from the trained band GMM model, band GMM calculation is performed according to equation 1 described above. Then, by comparing the class of a frame recognized through GMM calculation and label data known in the voice data, a band weight is trained. That is, from the band GMM model formed through the band GMM training 600, it is recognized that each frame string in the voice data is, for example, noise or silence, and by comparing the result with label data information which is known in advance, a weight for each band is calculated. The weight for each band is calculated according to equation 3 below:

$$O_k(t) = \begin{cases} 1, & \text{if } O(t) = O_k(t) \\ 0, & \text{otherwise} \end{cases} \quad (3)$$

-continued $$P(O_k \mid O, W_k) = \frac{1}{N} \sum_{n=1}^{N} O_k(t)$$

Here, $O_k(t)$ denotes a training label at time t, O(t) denotes a band GMM label at time t, K denotes a class index, and N denotes the number of entire labels of class K.

Figure 7:
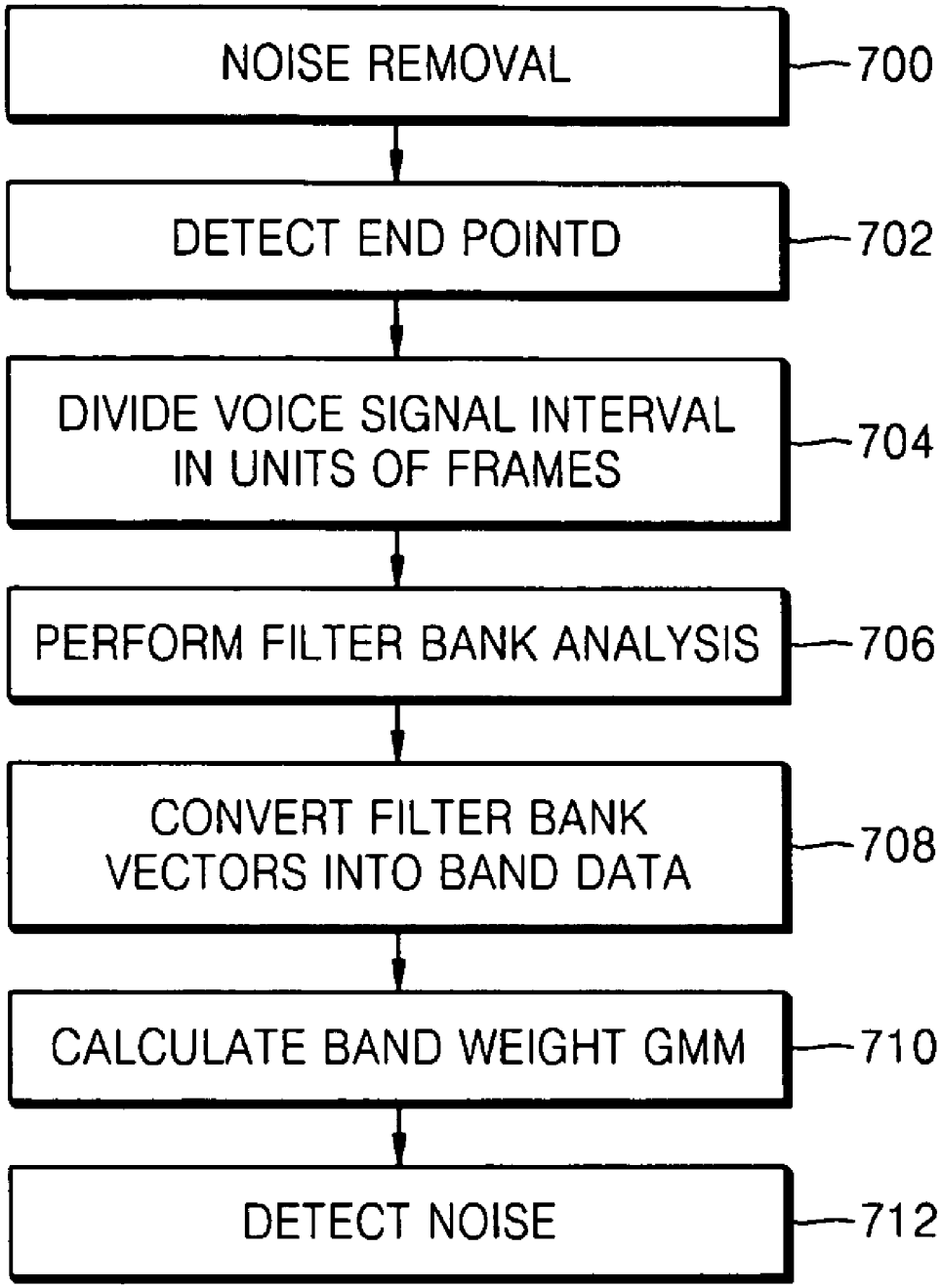
FIG. 7 is a flowchart explaining a method of detecting noise according to an embodiment of the present invention.

FIG. 7 is a flowchart explaining a method of detecting noise according to an embodiment of the present invention.

Referring to FIG. 7, noise is removed from voice input to a voice recognition device in operation 700. This is a preprocessing operation before extracting a characteristic for voice recognition. For this, a known noise removal technique, or a multiple microphone technique in which by predicting a time delay of a signal component input to multiple microphones, the effect of noise is minimized, or a spectral subtraction can be used.

In operation 702, through detection of an end point, only a speech part that is actually used for recognition is detected. The end point detection is a process for detecting only a speech interval. Generally, an energy value in each interval of an input signal is obtained and compared with a threshold predetermined based on statistical data, thereby detecting a speech interval and a silence interval. Also, a zero crossing rat considering a frequency characteristic together with an energy value can be used.

In operation 704, only an actual voice signal interval in which noise is removed is divided into frames. Then, the input frames obtained through the division are input to a noise detection apparatus according to the current embodiment.

In operation 706, with each input voice frame, filter bank analysis is performed in units of frames. That is, a voice frame signal is FFT transformed, and pass through a plurality of filter banks, thereby generating filter bank vectors for entire frequency bands. Then, in operation 708, the filter bank vectors are converted into band data.

In operation 710, by using the band data, band weight GMM calculations are performed. In operation 712, from the result value of the band weight GMM calculation for each input voice frame, it is determined whether or not detection object noise exists in the input frame.

The method of detecting noise according to the embodiment of the present invention can be applied to a variety of application fields related to voice recognition. For example, filter bank vectors obtained through filter bank analysis and band weight GMM-based label information can be applied to detection of end points. Also, by using identical band weight GMM-based label information, normalization of cepstrums for a silent interval and speech interval can be applied differently. Also, a part which is determined to be noise in the band weight GMM-based label information can be removed from a characteristic vector string which is used in a final recognition process in frame dropping.

The apparatus for detecting noise according to the embodiment of the present invention can be easily applied to mobile devices with a few resources, by using filter bank vector values generated in the process of forming characteristic vectors, without forming additional resources in order to detect noise.

The present invention can also be embodied as computer readable codes on a computer readable recording medium. The computer readable recording medium is any data storage device that can store data which can be thereafter read by a computer system.

Examples of the computer readable recording medium include read-only memory (ROM), random-access memory (RAM), CD-ROMs, magnetic tapes, floppy disks, optical data storage devices, and carrier waves (such as data transmission through the Internet). The computer readable recording medium can also be distributed over network coupled computer systems so that the computer readable code is stored and executed in a distributed fashion. Also, functional programs, codes, and code segments for accomplishing the present invention can be easily construed by programmers skilled in the art to which the present invention pertains.

While the present invention has been particularly shown and described with reference to exemplary embodiments thereof, it will be understood by those of ordinary skill in the art that various changes in form and details may be made therein without departing from the spirit and scope of the present invention as defined by the following claims. The preferred embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of detecting noise comprising:

receiving an input of a voice frame and converting the voice frame into a filter bank vector;

converting the converted filter bank vector into band data;

calculating a weight Gaussian mixture model (GMM) for each band by using the converted band data and filter bank order; and detecting noise in the voice frame based on the calculation result wherein in the converting of the converted filter bank vector into band data, the filter bank vectors for the entire frequency bands of the voice frame are converted into data for respective bands.

2. The method of claim 1, wherein in the calculating of the weight GMM for each band, the weight GMM for each band is calculated by applying a weight for the band to a GMM for the band which is trained in advance.

3. The method of claim 2, wherein the GMM for each band is trained by using predetermined voice data and label data.

4. The method of claim 3, wherein the weight for each band is trained by using the trained GMM for the band, voice data and label data.

5. The method of claim 4, wherein the weight for each band is calculated according to equation below:

$$O_k(t) = \begin{cases} 1, & \text{if } O(t) = O_k(t) \\ 0, & \text{otherwise} \end{cases}$$

$$P(O_k \mid O, W_k) = \frac{1}{N}\sum_{n=1}^{N} O_k(t)$$

where, $O_k(t)$ denotes a training label at time t, O(t) denotes a band GMM label at time t, K denotes a class index, and N denotes the number of entire labels of class K.

6. The method of claim 1, wherein the weight GMM for each band is calculated according to equation below:

$$L(O \mid \Phi) = \sum_{m=1}^{M}\left[\alpha \log w_m + \sum_{n=1}^{N}\{\log c_{mn} + \log N_m(O_m \mid \mu_{mn}, \sigma_{mn})\}\right]$$

where, $L(O|\Phi)$ denotes a likelihood, M denotes a filter bank order, N denotes the number of mixtures, $C_{mn}$ denotes a mixture weight for each band, $\mu_{mn}$ denotes a Gaussian mean for each band, $O_m$ denotes an Input frame for each band, $\sigma_{mn}$ denotes a Gaussian distribution for each band, $w_{mn}$ denotes a band weight, and a denotes a band weight scaling factor.

7. A non-transitory computer readable recording medium having embodied thereon a computer program for executing the method of claim 1.

8. An apparatus for detecting noise comprising:

a filter bank analysis unit receiving an input of a voice frame and converting the voice frame into a filter bank vector;

a band data converting unit converting the converted filter bank vector into band data;

a band weight GMM calculation unit calculating a weight GMM for each band by using the converted band data and filter bank order; and a noise detection unit detecting noise in the voice frame based on the calculation result, wherein the band data converted unit converts the filter bank vectors for the entire frequency bands of the voice frame into data for respective bands.

9. The apparatus of claim 8, wherein the weight GMM for each band is calculated according to equation below:

$$L(O \mid \Phi) = \sum_{m=1}^{M}\left[\alpha \log w_m + \sum_{n=1}^{N}\{\log c_{mn} + \log N_m(O_m \mid \mu_{mn}, \sigma_{mn})\}\right]$$

where, $L(O|\Phi)$ denotes a likelihood, M denotes a filter bank order, N denotes the number of mixtures, $C_{mn}$ denotes a mixture weight for each band, $\mu_{mn}$ denotes a Gaussian mean for each band, $O_m$ denotes an Input frame for each band, $\sigma_{mn}$ denotes a Gaussian distribution for each band, $w_{mn}$ denotes a band weight, and a denotes a band weight scaling factor.

10. The apparatus of claim 8, wherein the band weight GMM calculation unit calculates the weight GMM for each band by applying a weight for the band to a GMM for the band which is trained in advance.

* * * * *

UNITED STATES PATENT AND TRADEMARK OFFICE

CERTIFICATE OF CORRECTION

PATENT NO. : 8,275,612 B2
APPLICATION NO. : 12/081409
DATED : September 25, 2012
INVENTOR(S) : Nam-hoon Kim et al.

It is certified that error appears in the above-identified patent and that said Letters Patent is hereby corrected as shown below:

In the Claims:

Column 7; Line 33 (Approx.); In claim 1, after "result" insert -- , --.
Column 8; Line 16 (Approx.); In Claim 6, delete "Input" and insert -- input --, therefor.
Column 8; Line 18 (Approx.); In Claim 6, delete "a" and insert -- α --, therefor.
Column 8; Line 48 (Approx.); In Claim 9, delete "Input" and insert -- input --, therefor.
Column 8; Line 50 (Approx.); In Claim 9, delete "a" and insert -- α --, therefor.

Signed and Sealed this
Seventh Day of May, 2013

Teresa Stanek Rea
*Acting Director of the United States Patent and Trademark Office*